US011486243B2

(12) United States Patent
Collins

(10) Patent No.: US 11,486,243 B2
(45) Date of Patent: Nov. 1, 2022

(54) ESP GAS SLUG AVOIDANCE SYSTEM

(71) Applicant: GE Oil & Gas ESP, Inc., Oklahoma City, OK (US)

(72) Inventor: Charles Collins, Oklahoma City, OK (US)

(73) Assignee: Baker Hughes ESP, Inc., Houston, TX (US)

( * ) Notice: Subject to any disclaimer, the term of this patent is extended or adjusted under 35 U.S.C. 154(b) by 0 days.

(21) Appl. No.: 15/229,015

(22) Filed: Aug. 4, 2016

(65) Prior Publication Data

US 2018/0038214 A1 Feb. 8, 2018

(51) Int. Cl.

| | |
|---|---|
| ***E21B 43/38*** | (2006.01) |
| ***E21B 43/12*** | (2006.01) |
| ***E21B 47/06*** | (2012.01) |

(52) U.S. Cl.

CPC ..... *E21B 43/38* (2013.01); *E21B 43/128* (2013.01); *E21B 47/06* (2013.01)

(58) Field of Classification Search

CPC ..... E21B 43/38; E21B 33/12; E21B 43/18; E21B 43/128; E21B 47/06

See application file for complete search history.

(56) References Cited

U.S. PATENT DOCUMENTS 3,967,633 A 7/1976 Hallanger et al.
4,457,384 A 7/1984 Layton
4,545,731 A * 10/1985 Canalizo ..... F04F 1/08 417/111
4,751,940 A 6/1988 Bergsma et al.
5,904,209 A * 5/1999 Kenworthy ..... E21B 43/38 166/372
6,039,121 A * 3/2000 Kisman ..... E21B 43/121 166/272.7
6,352,109 B1 * 3/2002 Buckman, Sr. ..... E21B 43/122 166/250.03
7,311,152 B2 * 12/2007 Howard ..... E21B 43/129 166/250.15
8,113,274 B2 2/2012 Rivas et al.
8,186,211 B2 5/2012 Boult et al.
8,453,736 B2 6/2013 Constantine
8,640,930 B2 2/2014 Nunez et al.
(Continued)

OTHER PUBLICATIONS

Falser, S., et al., "Increased Gas Production from Hydrates by Combining Depressurization with Heating of the Wellbore," Energy & Fuels, vol. 26, pp. 6259-6267 (2012).
(Continued)

*Primary Examiner* — Robert E Fuller
*Assistant Examiner* — Neel Girish Patel
(74) *Attorney, Agent, or Firm* — Crowe & Dunlevy, P.C.

(57) ABSTRACT

A gas mitigation system for controlling the amount of gas that reaches a submersible pumping system deployed in a wellbore includes a well zone isolation device disposed in the wellbore between the submersible pumping system and a gas collecting region. The gas mitigation system further includes a back pressure control module and a gas vent line extending from the gas collecting region through the well zone isolation device to the back pressure control module. A liquid intake line extends from the well zone isolation device to an area of the wellbore upstream from the gas collecting region.

17 Claims, 4 Drawing Sheets

(56) References Cited

U.S. PATENT DOCUMENTS 8,794,305 B2 * 8/2014 Wilson ..... E21B 17/203 166/68
8,826,991 B2 * 9/2014 Steele ..... E21B 34/06 166/373
9,869,161 B2 * 1/2018 VanDam ..... E21B 43/38
2003/0159828 A1 * 8/2003 Howard ..... E21B 43/129 166/372
2005/0077040 A1 * 4/2005 Meyers ..... F04B 47/08 166/85.2
2006/0027378 A1 * 2/2006 Zimmerman ..... E21B 33/122 166/387
2006/0081378 A1 * 4/2006 Howard ..... F04F 1/08 166/372
2007/0051509 A1 * 3/2007 Selph ..... E21B 43/38 166/105
2007/0108201 A1 * 5/2007 Vinegar ..... C10L 3/08 219/770
2009/0084549 A1 * 4/2009 O'Malley ..... E21B 43/04 166/278
2009/0145595 A1 * 6/2009 Mazzanti ..... E21B 17/18 166/106
2010/0089588 A1 * 4/2010 Thompson ..... E21B 43/121 166/372
2011/0266001 A1 * 11/2011 Dykstra ..... E21B 43/12 166/319
2011/0278015 A1 * 11/2011 Mazzanti ..... E21B 43/121 166/372
2013/0098629 A1 * 4/2013 Wilson ..... E21B 17/203 166/372
2013/0199794 A1 * 8/2013 Lane ..... E21B 43/124 166/372
2013/0299240 A1 * 11/2013 Leuchtenberg ..... E21B 21/106 175/48
2014/0338887 A1 * 11/2014 Bullard ..... E21B 33/12 166/101
2015/0034325 A1 * 2/2015 Tolman ..... E21B 43/14 166/313
2015/0136411 A1 * 5/2015 Beg ..... E21B 21/001 166/357
2015/0136414 A1 * 5/2015 Hughes ..... E21B 43/122 166/372
2015/0204169 A1 * 7/2015 Coates ..... E21B 43/128 166/369
2016/0084042 A1 * 3/2016 VanDam ..... E21B 43/38 166/250.03
2016/0097270 A1 * 4/2016 Pobedinski ..... E21B 44/00 700/275
2016/0177666 A1 * 6/2016 Van Dam ..... F16K 31/122 166/250.15
2016/0319653 A1 * 11/2016 Reeves ..... E21B 43/121
2017/0167228 A1 * 6/2017 Maughan ..... E21B 43/00

OTHER PUBLICATIONS

Vandam, J.D., et al., Gas vent system and methods of operating the same, GE Co-Pending U.S. Appl. No. 62/053,571, filed Sep. 22, 2014.

* cited by examiner

ESP GAS SLUG AVOIDANCE SYSTEM

FIELD OF THE INVENTION

This disclosure relates generally to oil or gas producing wells, and more particularly to deviated wells having a gas vent system for removing gas from the wellbore.

BACKGROUND

The use of directionally drilled wells to recover hydrocarbons from subterranean formations has increased significantly in the past decade. With advancements in drilling technology, it is now possible to accurately drill wells with multiple horizontal deviations. Horizontal wells are particularly prevalent in unconventional shale plays, where vertical depths may range up to about 10,000 feet with lateral sections extending up to another 10,000 feet with multiple undulations. The geometry of the wellbore along the substantially horizontal portion typically exhibits slight elevation changes, such that one or more undulations (i.e., "peaks" and "valleys") occur. In at least some known horizontal wells, the transport of both liquid and gas phase materials along the wellbore results in unsteady flow regimes including terrain-induced slugging, such as gas slugging.

Fluids that have filled the wellbore in lower elevations impede the transport of gas along the length of the wellbore. This phenomenon results in a buildup of pressure along the length of the substantially horizontal wellbore section, reducing the maximum rate at which fluids can enter the wellbore from the surrounding formation. Continued inflow of fluids and gasses cause the trapped gas pockets to build in pressure and in volume until a critical pressure and volume is reached, whereby a portion of the trapped gas escapes past the fluid blockage and migrates as a slug along the wellbore. Furthermore, at least some known horizontal wells include pumps that are designed to process pure liquid or a consistent mixture of liquid and gas. Not only does operating the pump without pure liquids cause much lower pumping rates, but it may cause damage to the pump or lead to a reduction in the expected operational lifetime of the pump.

To cope with this type of terrain-induced slugging, one conventional technique includes the utilization of a gas vent tube, situated within the wellbore, that includes multiple mechanical valves distributed at various gas tube access points throughout the length of the wellbore. Each mechanical valve within the wellbore, for this conventional technique, is capable of remaining closed in the presence of liquid and opening passage to the gas tube vent in the absence of liquid. In this conventional manner, those mechanical valves located in a "valley" or at a relatively lower elevation horizontal wellbore undulation are configured to remain closed, preventing the ingress of liquid into the gas vent tube. On the other hand, those mechanical valves located at a "peak" or at a relatively higher elevation horizontal wellbore undulation are configured to automatically open to allow gas to enter the gas vent tube and escape to the surface. These mechanical valves may be passive valves or may be active valves that include one or more sensors (e.g., fluid sensors) to assist in determining the actuation of one or more valves. However, the reliability of mechanical valves, especially when thousands of feet under the surface, is problematic. Moreover, the utilization of active mechanical valves in a gas vent tube becomes even more cumbersome since a power supply and power delivery to each downhole active valve is required.

Similarly, another conventional technique includes replacing each mechanical valve with a gas-permeable membrane barrier that only allows the passage of gas, as opposed to liquid. The gas-permeable membrane may be pressure differential induced or merely allow gas molecules of particular sizes passage through the membrane. However, similar to a mechanical valve, gas-permeable membranes face reliability issues such as fouling (i.e., micro-passages for gas molecules become blocked by sand and debris) especially when situated in the harsh environment thousands of feet downhole. The pressure differentials across a gas-permeable membrane may also cause issues with reliability and purging the gas vent tube may require a much higher volume and pressure of gas due to purge gas leaking out of each gas-permeable membrane.

Thus, current methods reducing gas slugging in deviated wells has proven ineffective or undesirable. There is, therefore, a continued need for an improved gas slug avoidance system. It is to these and other deficiencies in the prior art that the present invention is directed.

SUMMARY OF THE INVENTION

In one aspect, the present invention includes a gas mitigation system for controlling the amount of gas that reaches a submersible pumping system deployed in a wellbore. The gas mitigation system includes a well zone isolation device disposed in the wellbore upstream from the submersible pumping system. The well zone isolation device includes an upstream side and a downstream side. The gas mitigation system further includes a back pressure control module and a gas vent line extending from the back pressure control module through the well zone isolation device. The back pressure control module is configured to maintain a gas collecting region adjacent the upstream side of the well zone isolation device. A liquid intake line extends through the well zone isolation device from an area of the wellbore adjacent the downstream side of the well zone isolation device to an area of the wellbore upstream from the gas collecting region.

In another aspect, the present invention includes a wellbore production system configured to efficiently produce liquid hydrocarbons from a wellbore. The wellbore production system includes a submersible pumping system deployed in the wellbore and a gas mitigation system. The gas mitigation system includes a well zone isolation device disposed in the wellbore upstream from the submersible pumping system. The well zone isolation device includes an upstream side and a downstream side. The gas mitigation system further includes a back pressure control module and a gas vent line extending from the back pressure control module through the well zone isolation device. The back pressure control module is configured to maintain a gas collecting region adjacent the upstream side of the well zone isolation device. A liquid intake line extends through the well zone isolation device from an area of the wellbore adjacent the downstream side of the well zone isolation device to an area of the wellbore upstream from the gas collecting region.

In yet another aspect, the present invention includes a method for mitigating gas slugging in a well in which a submersible pumping system is deployed. The method begins with the steps of installing a well zone isolation device in a region of the well upstream from the submersible pumping system, wherein the well zone isolation device includes a downstream side and an upstream side adjacent a gas collecting region. The method continue with the step of providing a liquid intake line that extends through the well zone isolation device from an area of the wellbore adjacent the downstream side of the well zone isolation device to an area upstream of the gas collecting region. The method also includes the step of providing a gas vent line that extends from a back pressure control module through the well zone isolation device to the gas collecting region. The method continues with the step of manipulating the back pressure control module to adjust the pressure of the gas in the gas vent line to maintain the volume and pressure of gas in the gas collecting region.

DETAILED DESCRIPTION OF THE PREFERRED EMBODIMENT

As used herein, the term "petroleum" refers broadly to all mineral hydrocarbons, such as crude oil, gas and combinations of oil and gas. Furthermore, as used herein, the term "two-phase" refers to a fluid that includes a mixture of gases and liquids. It will be appreciated by those of skill in the art that, in the downhole environment, a two-phase fluid may also carry solids and suspensions. Accordingly, as used herein, the term "two-phase" not exclusive of fluids that contain liquids, gases, solids, or other intermediary forms of matter.

Figure 1:
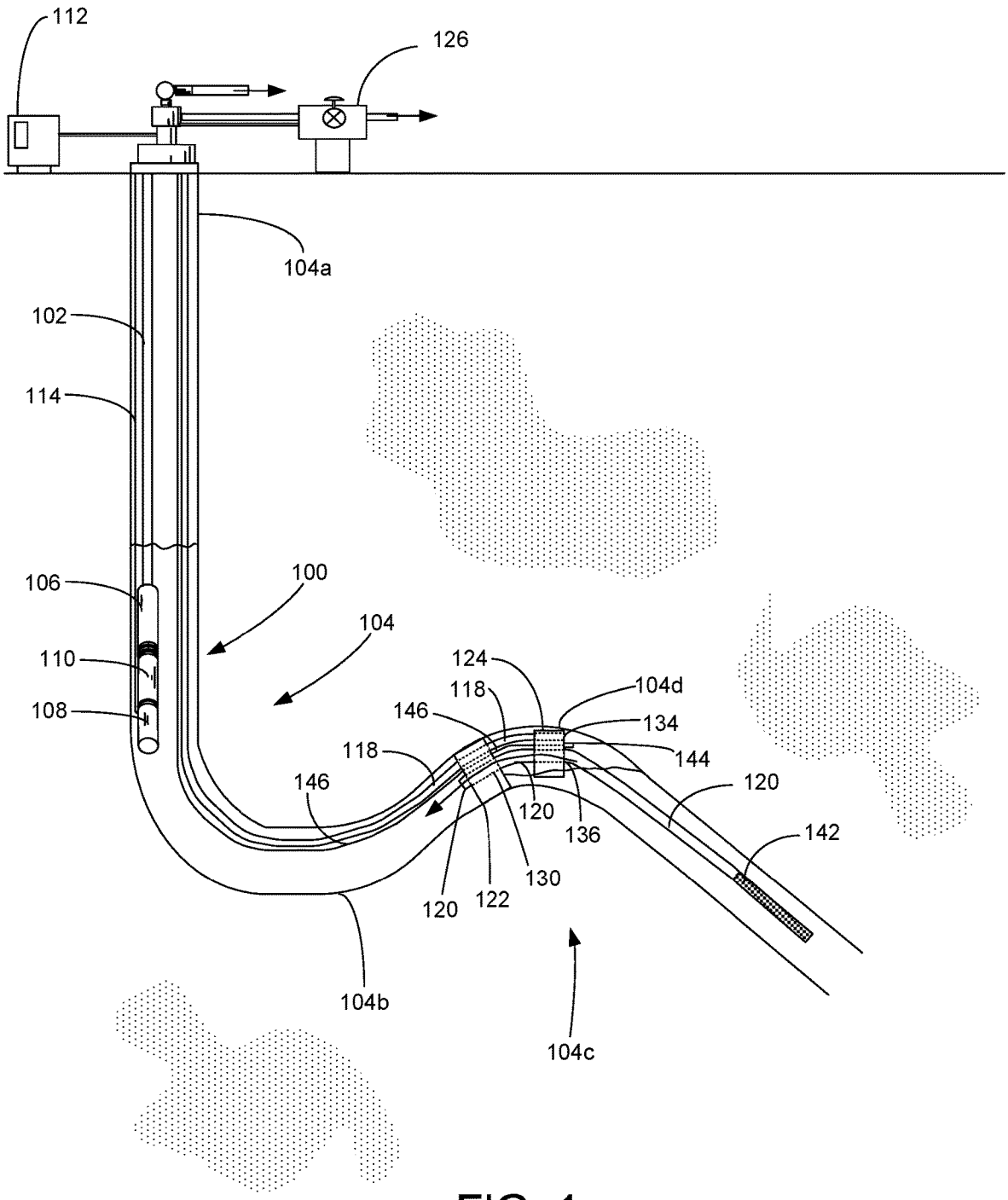
FIG. 1 is a gas mitigation system and electric submersible pump system deployed in a deviated wellbore.

FIG. 1 shows an elevational view of a submersible pumping system 100 attached to production tubing 102. The pumping system 100 and production tubing 102 are disposed in a wellbore 104, which is drilled for the production of a fluid such as water or petroleum. The pumping system 100 includes a pump assembly 106, a motor 108 and a seal section 110. The pump assembly 106 is configured as a multistage centrifugal pump that is driven by the motor 108. The motor 108 is configured as a three-phase electric motor that rotates an output shaft in response to the application of electric current at a selected frequency. The motor 108 is driven by a variable speed drive 112 positioned on the surface. Power is conveyed from the variable speed drive 112 to the motor 108 through a power cable 114.

The seal section 110 shields the motor 108 from mechanical thrust produced by the pump assembly 106 and provides for the expansion of motor lubricants during operation. Although only one of each component is shown, it will be understood that more can be connected when appropriate. For example, in many applications, it is desirable to use tandem-motor combinations, multiple seal sections and multiple pump assemblies. It will be further understood that the pumping system 100 may include additional components, such as shrouds and gas separators.

As depicted in FIG. 1, the wellbore 104 generally includes a vertical section 104*a* and a lateral section 104*b*. By design or otherwise, the lateral section 104*b* may include one or more vertical undulations 104*c*. These undulations 104*c* will include a peak 104*d* that is higher than the surrounding portions of the lateral section 104*b*. It will be further understood that the depiction of the wellbore 104 is illustrative only and the presently preferred embodiments will find utility in wellbores of varying depths and configurations. The wellbore 104 may, for example, be a conventional vertical well or include sections that are deviated from vertical without undulations.

Figure 2:
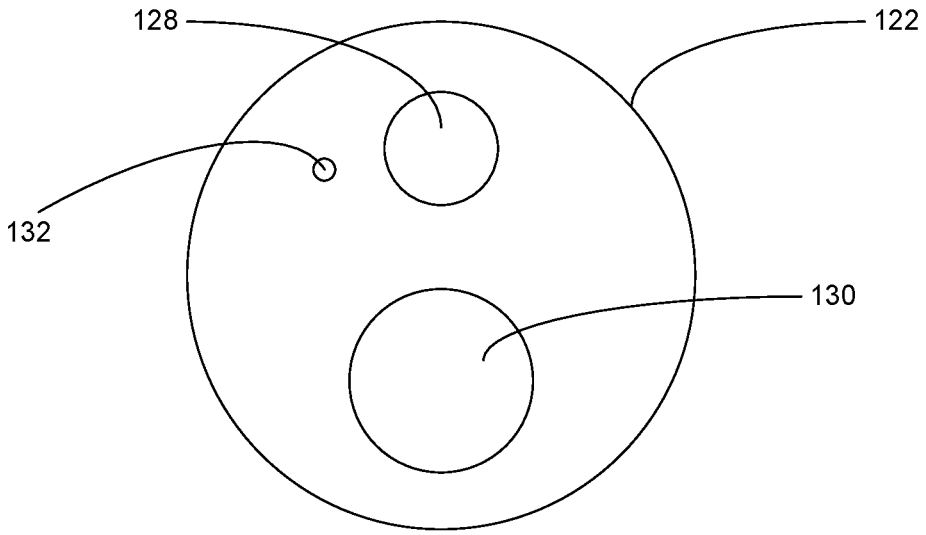
FIG. 2 is a front view of a well zone isolation device from the gas mitigation system of FIG. 1.

For the purposes of the disclosure herein, the terms "upstream" and "downstream" shall be used to refer to the relative positions of components or portions of components with respect to the general flow of fluids produced from the wellbore 104. "Upstream" refers to a position or component that is passed earlier than a "downstream" position or component as fluid is produced from the wellbore 104. The terms "upstream" and "downstream" are not necessarily dependent on the relative vertical orientation of a component or position A gas mitigation system 116 is used to reduce the risk and effects of gas slugging at the pumping system 100. In the embodiment depicted in FIG. 1, the gas mitigation system 116 includes a gas vent line 118, a liquid intake line 120, a well zone isolation device, a gas intake 124 and a back pressure control module 126. The well zone isolation device 122 can be a packer or similar sealing device that is placed between the pumping system 100 and a portion of the wellbore 104 where gas is likely to collect. As depicted in FIG. 1, the well zone isolation device 122 is placed between the pumping system 100 and the peak 104*d* of the undulation 104*c*. The well zone isolation device 122 is sized and configured to make a tight seal within the wellbore 104. As illustrated in FIG. 2, the well zone isolation device 122 includes a gas line port 128, a liquid line port 130 and a sensor port 132. The gas mitigation system 116 may be provided with the pumping system 100 or deployed without the pumping system 100 in certain applications. The combined use of the pumping system 100 and gas mitigation system 116 provide a wellbore production system 200 that is well suited to optimize the production of liquid hydrocarbons from a well that also produces large volumes of gas.

Figure 3:
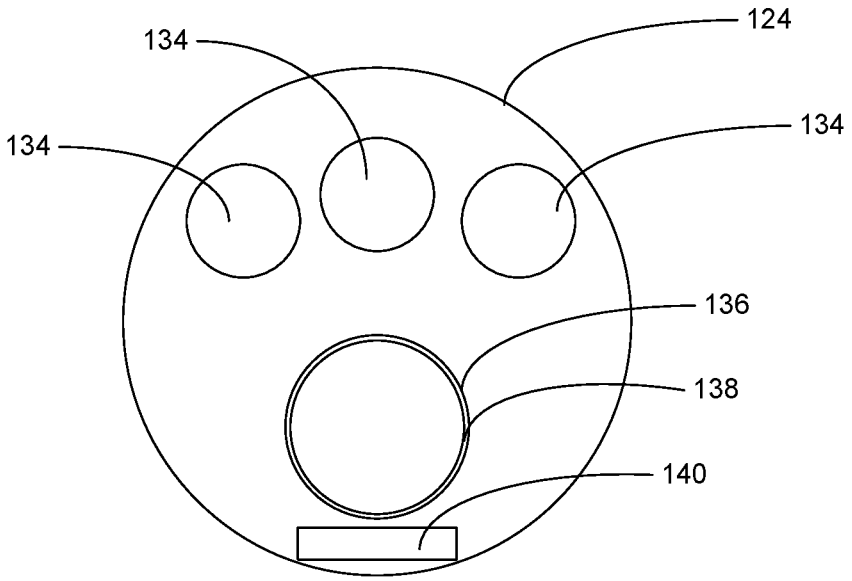
FIG. 3 is a front view of a gas intake from the gas mitigation system of FIG. 1.

As shown in FIG. 1, the gas intake 124 is positioned upstream from the well zone isolation device 122 and preferably in the region of the wellbore 104 in which gas tends to collect. For wellbores 104 that include an undulation 104*c*, the gas intake 124 may be optimally positioned at or near the peak 104*d*. As illustrated in FIG. 3, the gas intake 124 includes one or more gas intake ports 134 positioned above a liquid line aperture 136. The gas intake 124 may optionally include a bearing 138 around the liquid line aperture 136 that allows the gas intake 124 to rotate around the liquid intake line 120. The gas intake 124 optionally includes a counterweight 140 to encourage the gas intake 124 to rotate to a position around the liquid intake line 120 such that the one or more gas intake ports 134 is near the top of the cross-section of the wellbore 104.

The liquid intake line 120 extends through the liquid line port 130 of the well zone isolation device 122, through the liquid line aperture 136 of the gas intake port 134 to an upstream portion of the wellbore 104. The liquid intake line 120 can be constructed from coiled tubing or other flexible tubing that is resistant to the heat, temperature, pressures and corrosive chemicals found in the wellbore 104. The liquid intake line 120 extends into a portion of the wellbore 104 that is typically filled with fluid. Pressured exerted on the fluid upstream of the well zone isolation device 122 forces the wellbore fluid into the liquid intake line 120, where it is carried through the gas intake 124 and well zone isolation device 122, where it is discharged into a region of the wellbore 104 between the well zone isolation device 122 and the pumping system 100.

The liquid intake line 120 optionally includes a screened intake 142. The screened intake 142 reduces the amount of solid particles and entrained gas that pass through the liquid intake line 120. In particular, the screened intake 142 reduces the velocity of fluid entering the liquid intake line 120 to reduce the risk that large volumes of gas are pushed into the liquid intake line 120.

The gas vent line 118 extends from the gas intake 124, through the gas line port 128 of the well zone isolation device 122 to the back pressure control module 126 located on the surface. The gas vent line 118 can be constructed from coiled tubing or other flexible tubing that is resistant to the heat, temperature, pressures and corrosive chemicals found in the wellbore 104. Gas leaving the back pressure control module 126 is directed to downstream storage, disposal or processing facilities.

The back pressure control module 126 is configured to automatically adjust the gas pressure within the gas vent line 118 and the pressure of the gas in the wellbore upstream of the well zone isolation device 122. Increasing the back pressure in the region adjacent the gas intake 124 generally forces more fluid through the liquid intake line 120 and thereby adjusts the level of fluid between the well zone isolation device 122 and the liquid intake line 120. Maintaining the liquid level at or below the bottom of the gas intake 124 reduces the risk that liquid is drawn into the gas vent line 118.

The gas mitigation system 116 may also include a pressure sensor 144 installed in the gas intake 124 or well zone isolation device 122. The pressure sensor 144 is connected to the back pressure control module 126 with a sensor line 146 that extends from the pressure sensor 144 through the sensor port 132 in the well zone isolation device 122. In response to pressure signals generated by the pressure sensor 144, the back pressure control module 126 automatically adjusts the back pressure on the gas vent line 118 to control the level and flow of fluid upstream of the well zone isolation device 122. The signals generated by the pressure sensor 144 can also be provided to the variable speed drive 112 to adjust the operating parameters of the pumping system 100.

Figure 4:
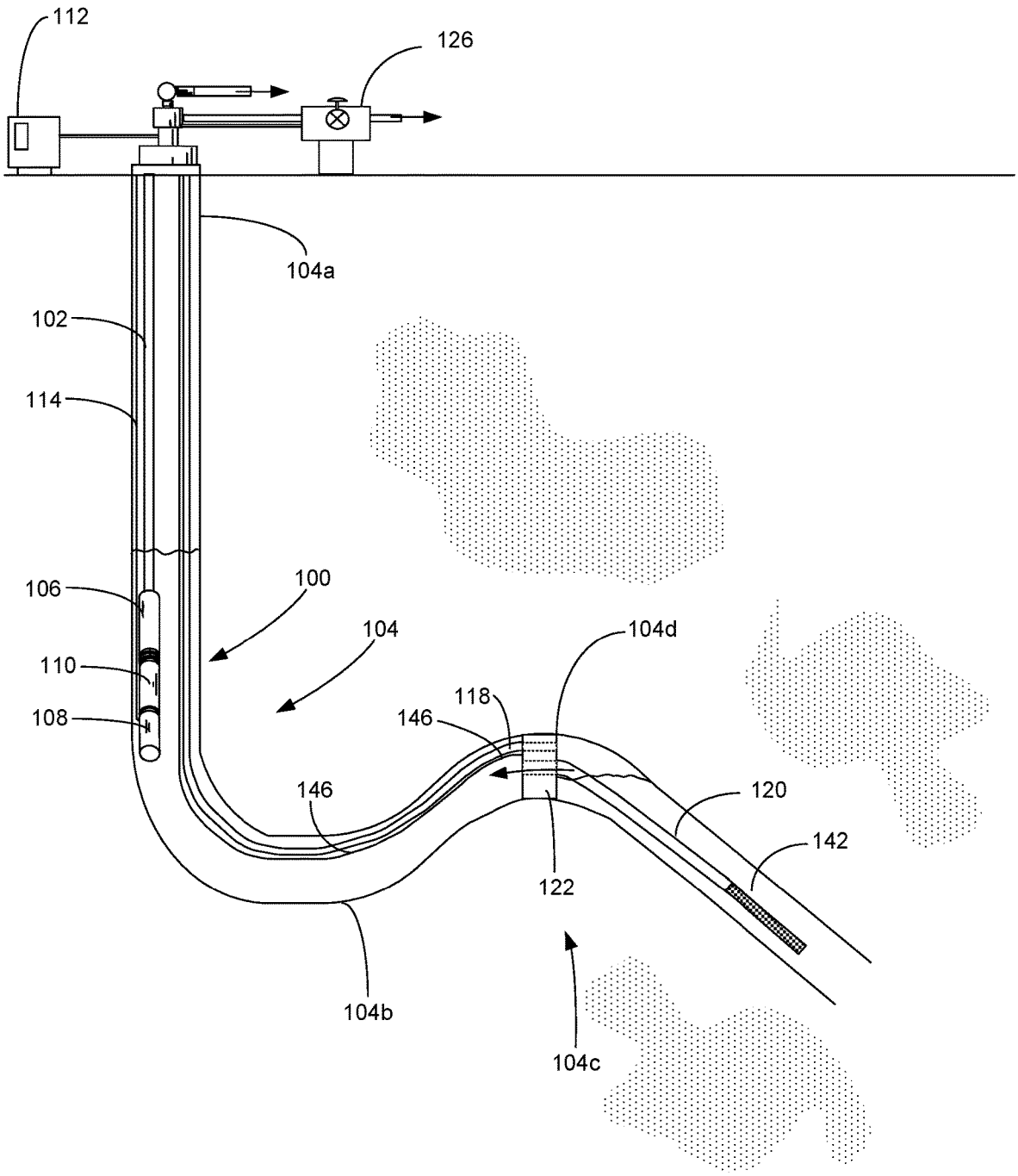
FIG. 4 depicts an alternate embodiment of a gas mitigation system and electric submersible pump system deployed in a deviated wellbore.

Turning to FIG. 4, shown therein is an alternate embodiment in which the gas mitigation system 116 does not include the gas intake 124. In this embodiment, the liquid intake line 120 and gas vent line 118 extend through the well zone isolation device 122 and the well zone isolation device 122 is positioned near the peak 104*d* of the undulation 104*c*. As with the embodiment depicted in FIG. 1, the control of the gas pressure upstream from the well zone isolation device 122 is accomplished with adjustments made by the back pressure control module 126.

Thus, the gas mitigation system 116 is configured to control the introduction of large slugs of gas through a liquid intake by controllably purging gas collected against the well zone isolation device 122 to maintain a selected backpressure upstream from the well zone isolation device 122. Maintaining the backpressure between the well zone isolation device 122 reduces the risk that gas is drawn into the liquid intake line 120 or that liquid is pushed into the gas vent line 118.

Although the gas mitigation system 116 is well-suited for deployment with submersible pumping systems in deviated wellbores, it will be appreciated that the gas mitigation system 116 can also be used in combination with other artificial lift technologies. For example, it may be desirable to deploy the gas mitigation system 116 in combination with surface-based beam pumping systems, plunger lift systems and submersible positive displacement pumps. Thus, the wellbore production system 200 may alternatively include the combined use of the gas mitigation system 116 with other artificial lift systems, including beam pumping systems.

Figure 5:
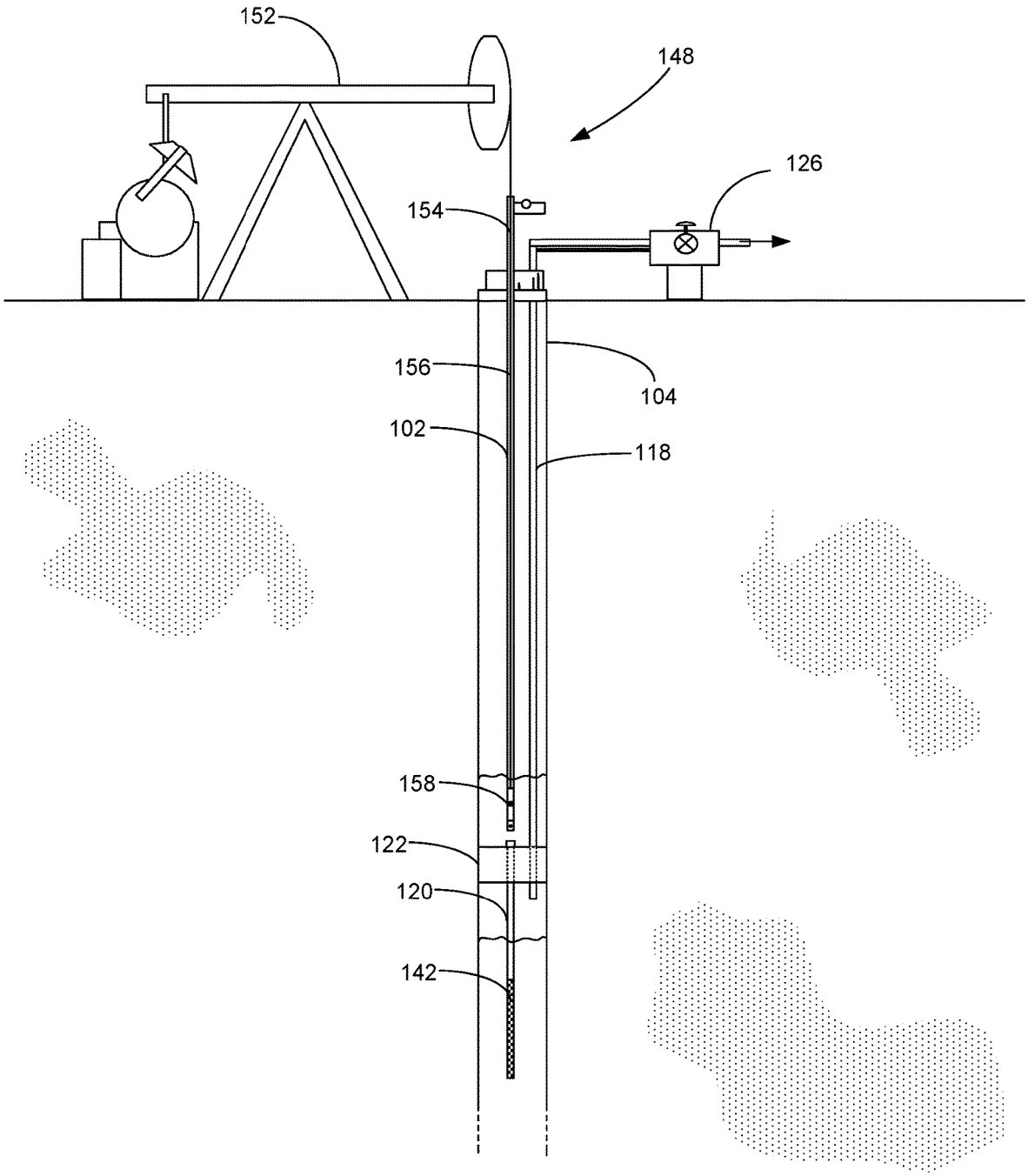
FIG. 5 depicts an alternate embodiment of a gas mitigation system deployed in combination with a sucker rod pump in a conventional wellbore.

Turning to FIG. 5, shown therein is a depiction of an embodiment of the gas mitigation system 116 deployed in connection with a surface-based beam pumping system 148. The beam pumping system 148 is deployed in a conventional vertical well 150. The beam pumping system 148 includes a pump jack 152, a polished rod 154, a plurality of sucker rods 156 and a downhole reciprocating pump 158.

In accordance with well-known operating principles, the pump jack 152 causes the polished rod 154 to reciprocate through a stuffing box on the wellhead (not separately designated). The reciprocating motion of the polished rod 154 is transferred to the downhole reciprocating pump 158 through the sucker rods 156. The sucker rods 156 extend through the production tubing 102. During an upstroke, fluid is drawn into the downhole reciprocating pump 158 through intake valves (not shown). During a downstroke, the volume within the downhole reciprocating pump 158 is reduced and fluid is forced upward through the production tubing 102. As used in this description, the term "submersible pumping system" also includes the downhole reciprocating pump 158.

In the embodiment depicted in FIG. 5, the downhole reciprocating pump 158 is placed at or near the bottom of the production tubing 102. The well zone isolation device 122 is disposed in the vertical well 150 below the downhole reciprocating pump 158. The liquid intake line 120 extends through the well zone isolation device 122 and optionally includes the screened intake 142. The gas vent line 118 extends from the surface through the well zone isolation device 122 to controllably release gas from the wellbore 104 while maintaining a pocket of gas downhole from the well zone isolation device 122. The pressurized pocket of gas below the well zone isolation device 122 forces liquid through the liquid intake line 120 to the intake of the downhole reciprocating pump 158 above the well zone isolation device 122. In alternate embodiments, the downhole reciprocating pump 158 and production tubing can be connected directly to the liquid intake line 120, either above or below the well zone isolation device 122.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A gas mitigation system for controlling the amount of gas that reaches a submersible pumping system deployed in a wellbore, wherein the wellbore includes a lateral section that includes an undulation with a peak that forms a gas collecting region in the wellbore, the gas mitigation system comprising:

a well zone isolation device disposed in the wellbore upstream from the submersible pumping system, wherein the well zone isolation device has an upstream side and a downstream side;

a back pressure control module configured to increase gas pressure on the upstream side of the well zone isolation device;

a gas vent line extending from the back pressure control module through the well zone isolation device;

a gas intake deployed in the gas collecting region upstream from the well zone isolation device, wherein the gas intake comprises:

a liquid line aperture; and a gas intake port above the liquid line aperture, wherein the gas vent line passes through the gas intake port to connect the back pressure control module to the gas collecting region;

a liquid intake line extending through the well zone isolation device and the liquid line aperture of the gas intake from an area of the wellbore adjacent the downstream side of the well zone isolation device to an area of the wellbore upstream from the gas collecting region; and wherein the back pressure control module is configured to maintain the back pressure of gas collected in the gas collecting region of the wellbore to prevent liquid from entering the gas vent line and to prevent gas from entering the liquid intake line.

2. The gas mitigation system of claim 1, wherein the liquid intake line includes a screened intake.

3. The gas mitigation system of claim 1, wherein the gas intake includes a plurality of gas intake ports in communication with the gas vent line.

4. The gas mitigation system of claim 3, wherein the gas intake further comprises:

a bearing surrounding the liquid line aperture; and a counterweight below the bearing that causes the gas intake to rotate to a position in which the gas intake ports are above the liquid line aperture.

5. The gas mitigation system of claim 1, further comprising a pressure sensor configured to detect the pressure in the gas vent line.

6. The gas mitigation system of claim 5, wherein the back pressure control module is configured to automatically adjust the pressure in the gas vent line in response to signals produced by the pressure sensor.

7. A wellbore production system configured to efficiently produce liquid hydrocarbons from a wellbore, wherein the wellbore includes a lateral section that includes an undulation with a peak that forms a gas collecting region in the wellbore, the wellbore production system comprising:

a submersible pumping system deployed in the wellbore; and a gas mitigation system comprising:

a well zone isolation device disposed in the wellbore upstream from the submersible pumping system, wherein the well zone isolation device has an upstream side and a downstream side;

a gas intake deployed in the gas collecting region of the wellbore upstream from the well zone isolation device;

a back pressure control module configured to increase gas pressure in the gas collecting region on the upstream side of the well zone isolation device;

a gas vent line extending from the back pressure control module through the well zone isolation device and the gas intake;

a liquid intake line extending through the well zone isolation device and gas intake from an area of the wellbore adjacent the downstream side of the well zone isolation device to an area of the wellbore upstream from the gas collecting region; and wherein the back pressure control module is configured to maintain the back pressure of gas collected in the gas collecting region of the wellbore to prevent liquid from entering the gas vent line and to prevent gas from entering the liquid intake line.

8. The wellbore production system of claim 7, wherein the operation of the submersible pumping system is controlled in response to measurements taken by the back pressure control module.

9. The wellbore production system of claim 7, wherein the liquid intake line includes a screened intake.

10. The wellbore production system of claim 7, wherein the gas intake includes one or more gas intake ports in communication with the gas vent line.

11. The wellbore production system of claim 10, wherein the gas intake further comprises a liquid line aperture through which the liquid intake line passes.

12. The wellbore production system of claim 11, wherein the gas intake further comprises:

a bearing surrounding the liquid line aperture; and a counterweight below the bearing that causes the gas intake to rotate to a position in which the gas intake ports are above the liquid line aperture.

13. The wellbore production system of claim 12, wherein the gas mitigation system further comprises a pressure sensor configured to detect the pressure in the gas vent line.

14. The wellbore production system of claim 13, wherein the back pressure control module is configured to automatically adjust the pressure in the gas vent line in response to signals produced by the pressure sensor.

15. A method of mitigating gas slugging in a well in which a submersible pumping system is deployed, wherein the well includes a lateral section that includes an undulation with a peak that provides a gas collecting region, the method comprising the steps of:

installing a well zone isolation device between the submersible pumping system and the peak of the undulation, wherein the well zone isolation device includes a downstream side closer to the submersible pumping system and an upstream side adjacent the gas collecting region;

providing a liquid intake line that extends through the well zone isolation device from an area of the wellbore adjacent the downstream side of the well zone isolation device to an area upstream of the gas collecting region;

providing a gas vent line that extends from a back pressure control module through the well zone isolation device to the gas collecting region; and preventing liquid from entering the gas vent line by manipulating the back pressure control module to increase the pressure of the gas in the gas vent line to maintain the volume and pressure of gas in the gas collecting region within the peak of the undulation in the lateral section of the well.

16. The method of claim 15 further comprising the step of providing a pressure sensor near the well zone isolation device.

17. The method of claim 16, wherein the step of manipulating the back pressure control module further comprises the step of manipulating the back pressure control module automatically in response to signals produce by the pressure sensor.

* * * * *